United States Patent [19]

Moses

[11] 4,250,630

[45] Feb. 17, 1981

[54] TOBACCO-PIPE HOLDER AND DRYER

[76] Inventor: Leonard L. Moses, 1212 Elmwood, Pasadena, Tex. 77502

[21] Appl. No.: 108,141

[22] Filed: Dec. 28, 1979

Related U.S. Application Data

[63] Continuation-in-part of Ser. No. 6,094, Jan. 24, 1979.

[51] Int. Cl.[3] ..... F26B 23/06

[52] U.S. Cl. ..... 34/104; 131/244; 211/60 M; 219/370

[58] Field of Search ..... 34/104, 53; 219/368, 219/370, 373; 131/172, 178, 244; 211/60 M

[56] References Cited

U.S. PATENT DOCUMENTS

| | | | |
|---|---|---|---|
| 2,708,796 | 5/1955 | Adamy | 34/104 |
| 3,587,594 | 6/1971 | Keller | 34/104 |

FOREIGN PATENT DOCUMENTS

| | | | |
|---|---|---|---|
| 5137 | of 1899 | United Kingdom | 131/172 |
| 24199 | of 1911 | United Kingdom | 211/60 M |

*Primary Examiner*—Larry I. Schwartz
*Attorney, Agent, or Firm*—Neal J. Mosely

[57] ABSTRACT

A tobacco pipe holder and dryer comprises a hollow housing having a cylindrical base portion and an upper portion opening from the base portion extending upward and flared outward therefrom and having around its upper periphery a plurality of downwardly directed nozzle outlets. A plurality of radially extending support members are pivotally supported on said housing and aligned with said nozzle outlets. A cup shaped supporting member is pivotally supported on the outer end of each of said support members and is movable into and out of juxtaposition to said nozzle outlets for supporting a pipe bowl with a nozzle outlet positioned therein. The apparatus includes springs urging each of said pivotal support members toward said nozzle outlets. The housing base portion has one or more air inlet openings, preferably louvered openings, and encloses a blower and an electric motor for operating the same. An electric heater is positioned in the housing above the blower for heating air circulating to said nozzle outlets. The apparatus is provided with switches independently controlling the electric heater and the blower motor and preferably includes a time operated switch for timed operation of the heater and blower.

8 Claims, 3 Drawing Figures

TOBACCO-PIPE HOLDER AND DRYER

CROSS REFERENCE TO RELATED APPLICATION

This application discloses, in part, subject matter disclosed in copending application Ser. No. 6,094, filed Jan. 24, 1979.

BACKGROUND OF THE INVENTION

1. Field of the Invention

This invention relates to new and useful improvements in pipe holders and, more particularly, to an improved dryer and holder for smoking pipes.

2. Brief Description of the Prior Art

It is well known that pipes tend to accumulate a substantial amount of fluid during use and often must be allowed to dry for an extended perior between periods of use. Several attempts have been made at providing means for drying smoking pipes but these have involved complicated and in many cases, inefficient equipment.

Moore U.S. Pat. No. 2,447,084 discloses a smoking pipe holder and dryer in which the pipes are supported on a rack within an enclosure and are positioned with the pipe bowls facing downward over a convection heater.

Kravitt U.S. Pat. No. 2,488,087 discloses a pipe rack mounted on an electric lamp base so that pipes supported thereon would tend to be dried by convection currents of air when the light is illuminated.

Wasserlein U.S. Pat. No. 2,809,441 discloses an enclosed, smoking-pipe dryer having forced circulation of heated air.

Wolfe U.S. Pat. No. 3,056,412 discloses a holder for supporting tobacco pipes on an air vent window in an automobile to provide circulating air flowing over the pipe.

Keller U.S. Pat. No. 3,587,594 discloses a smoking-pipe conditioner including forced air circulation.

Ellison U.S. Pat. No. 3,640,001 discloses a tobacco pipe conditioning apparatus wherein the pipes are positioned within a vacuum container and provided with some heat by a lamp bulb to assist in drying the pipes stored in the apparatus.

Gavlick U.S. Pat. No. 3,786,576 discloses a smoking-pipe conditioner in which a pipe is supported in an inverted position over an air nozzle.

SUMMRY OF THE INVENTION

It is one object of this invention to provide a new and improved apparatus for conditioning smoking pipes during the breaking in of the pipe and also to dry the pipes during further use thereof.

Another object of this invention is to provide a new and improved apparatus in the form of a smoking pipe holder having a forced air circulation dryer associated therewith.

Another object of this invention is to provide a new and improved smoking pipe holder and dryer having a plurality of downwardly directing nozzles and a plurality of pivotally movable support members operable to support pipe bowls into juxtaposition to said nozzles for circulation of heated air therethrough.

Still another object of this invention is to provide an improved smoking pipe holder and dryer which will accomodate pipes of varying sizes and shapes for storage and drying.

Yet another object of this invention is to provide a pipe support having a plurality of radial pipe supporting arms that are pivotally movable and telescoping in construction for supporting pipes against downwardly directed air nozzles for circulation of heated air into the pipe bowls.

Other objects of this invention will become apparent from time to time throughout the specification and claims as hereinafter related.

A tobacco pipe holder and dryer comprises a hollow housing having a cylindrical base portion and an upper portion opening from the base portion extending upward and flared outward therefrom and having around its upper periphery a plurality of downwardly directed nozzle outlets. A plurality of radially extending support members are pivotally supported on said housing and aligned with said nozzle outlets. A cup shaped supporting member is pivotally supported on the outer end of each of said support members and is movable into and out of juxtaposition to said nozzle outlets for supporting a pipe bowl with a nozzle outlet positioned therein. The apparatus includes springs urging each of said pivotal support members toward said nozzle outlets. The housing base portion has one or more air inlet openings, preferably louvered openings, and encloses a blower and an electric motor for operating the same. An electric heater is positioned in the housing above the blower for heating air circulating to said nozzle outlets. The apparatus is provided with switches independently controling the electric heater and the blower motor and preferably includes a time operated switch for timed operation of the heater and blower.

DESCRIPTION OF THE PREFERRED EMBODIMENT

Figure 1:
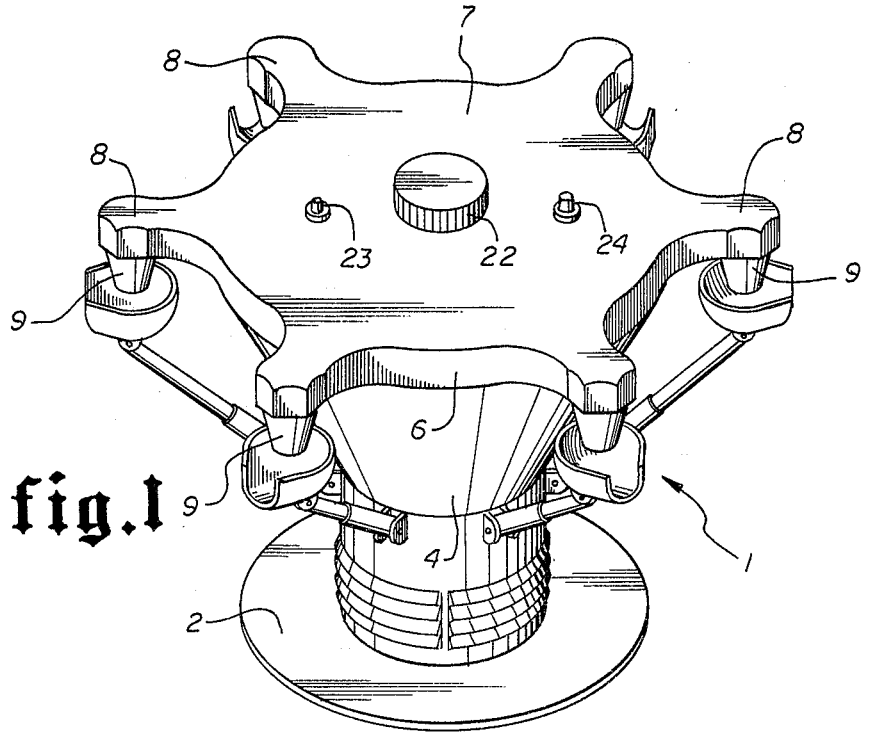
FIG. 1 is an isometric view of a preferred smoking pipe holder and dryer constructed in accordance with this invention.
Figure 2:
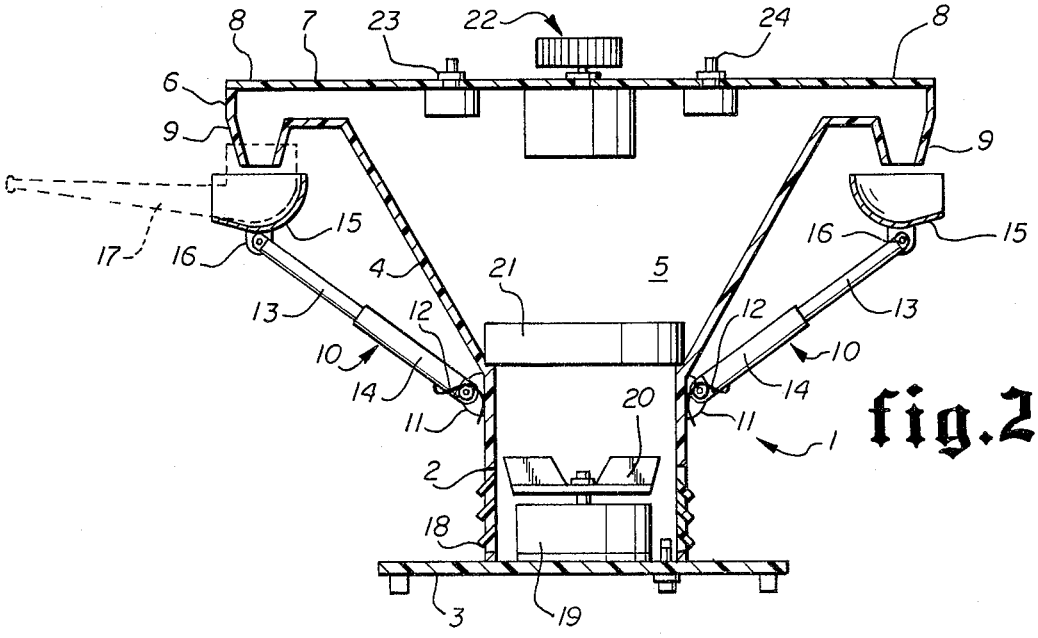
FIG. 2 is a view in central section of the apparatus shown in FIG. 1.

Referring to the drawings by the numerals of reference, and more particularly to FIGS. 1 and 2, there is shown a preferred embodiment of the smoking pipe holder and drying apparatus. The pipe holder and drying apparatus 1 is of a pedestal type construction and includes a housing having a cylindrical hollow base portion 2 secured on a supporting plate 3. An upper housing portion 4 opens from the base housing portion 2 and extends upwardly and is flared outwardly therefrom and defines an enlarged upper chamber 5. Upper housing portion 4 has a peripheral wall 6 which is closed by a top plate member 7 which encloses chamber 5 and which also defines a plurality of radially extending conduits 8 which terminate downwardly extending nozzle outlets 9 in the embodiment shown, there are six radially extending conduits 8 and six downwardly extending nozzle outlets 9.

The apparatus is provided with a plurality of radially extending support members 10 which are pivotally supported on lower housing portion 2 on hinge members 11 and are provided with springs 12 urging the support members 10 upward. Support members 10 are pivotal arms and are of telescoping construction consisting of piece 13 which telescopes inside of piece 14. At the upper end of pivotal support member 10 a cup shape supporting member 15 is pivotally supported thereon as indicated at 16. Cup shape supporting member 15 is operable to support a pipe 17, shown in dotted line, and holds the bowl of the pipe in juxtaposition to one of the nozzle outlets 9. Spring 12 is of sufficient strength to support arm 10 and cup shape supporting member 15 and hold pipe 17 against nozzle outlet 9. The telescoping construction of arm members 13 and 14 allows for radial adjustment of the support member 15 to center the pipe bowl on nozzle outlet 9.

The cylindrical bse portion 2 of the housing is provided with louvered air inlet openings 18 for admission of outside air to the apparatus. Electric motor 19 is supported on supporting plate 3 and operates blower 20 to draw air through louvered inlets 18 for circulation through the apparatus. An electric heater 21 is positioned at the outlet from the lower chamber enclosed by cylindrical housing 2. Electric heater 21 preferably consists of a plurality of strip heaters which are self-limiting heaters. Suitable self-limiting heaters are AUTO-TRACE self-limiting heaters manufactured by Chemelex Division of Raychem Corporation. The self-limiting strip heaters are rated at 8 watts per foot of length. These heaters are effective to maintain a constant air temperature of 225° F. Also other positive temperature coefficient heating elements, such as the "Honeycomb" element may be used. Blower motor 19 is rated at 110 V, 2100 RPM, 75 watts, continuous duty rating.

Upper plate member 7 which closes upper chamber 5 supports time switch 22 and off-on switches 23 and 24 controlling the blower and heater, respectively.

Figure 3:
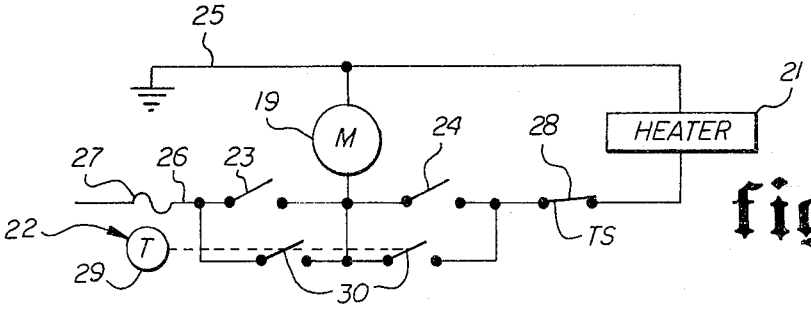
FIG. 3 is a wiring diagram for the electric motor and heater coils and timer used in the apparatus shown in FIG. 1.

In FIG. 3, there is shown a wiring diagram for the blower and heater circuits. Electric leads 25 and 26 are connected to electric current source 27 which may be a household current outlet. Electric motor 19 is connected between leads 25 and 26 and controlled by switch 23. Electric heater 21 is connected between leads 25 and 26 and is controlled by switch 24. The motor 19 and heater 21 are connected in parallel and the arrangement of switches is such that heater 21 can not be energized unless the switch 23 is closed energizing blower motor 19. The system is also provided with a thermostatic switch 28 which may be a bimetallic switch or the like. Timer switch 22 consists of a suitable timer motor 29 and double pull switch 30 which controls energization of motor 19 and heater coils 21. If desired, the system may also be provided with suitable fuses which provide for further safety in the event of overloading.

OPERATION

The operation of this apparatus should be fairly apparent from the description of the various components and the mode of assembly. A more detailed description of operation, however, is provided to clarify any points left unanswered in the general description of construction.

Due to the moisture condensing into the bowl and stem of a smoking pipe, there is a need to dry the pipe in order to enhance smoking pleasure. This apparatus is designed to provide for rapid drying of smoking pipes.

In using the apparatus, one or more pipes 17 are positioned in supporting cups 15 and the bowl of the pipe centered over and held in juxtaposition 2 nozzle outlets 9. The apparatus is turned on, either by the manual switches 23 and 24 or the timer 22. In either case, the blower motor 19 is energized and heater 21 is energized to provide heat to the circulating air. Air is drawn in through louvered opening 18 in the cylindrical base portion of housing 2. Air circulated by blower 20 flows past heater 21 where the air is heated to an elevated temperature, preferably about 225° F. The heated air is blown through upper chamber 5 and radially outward through radial conduits 8 and discharged through nozzle outlets 9. The pipes 17 are held firmly in juxtaposition 2 nozzle outlets 9 for circulation of air into pipe bowls and exhausted through the pipe stem or the bottom opening of the pipe bowl whenever the stem is removed.

The apparatus is designed to dry up to six pipes simultaneously in about 15—30 minutes. The pipes, however, can remain installed with the apparatus operating continuously without damage to the pipes or the apparatus. The housing of the apparatus is preferably made of a molded plastic or other suitable material which is not damaged by extended exposure to air heated to 225° F.

While this invention has been described fully and completely, with special emphasis upon the single preferred embodiment and illustrating the best mode of carrying out the invention, it should be understood that, within the scope of the appended claims, the invention may be practiced otherwise than as specifically described herein.

I claim:

1. A tobacco smoking pipe holder and dryer comprising a housing having a cylindrical base portion and and upper portion opening from said base portion, extending upward and flared outward therefrom and having around its upper periphery a plurality of downwardly directed nozzle outlets, a plurality of radially extending support members pivotally supported on said housing and aligned with said nozzle outlets, a cup shaped supporting member pivotally supported on the outer end of each of said support members and movable into and out of juxtaposition to said nozzle outlets for supporting a pipe bowl with a nozzle outlet positioned therein, spring means urging each of said support members toward said nozzle outlets, air inlet means in said housing base portion, blower means positioned in said housing base portion, electric heating means positioned in said housing to heat air circulated by said blower means, and means controlling energization of said heating means and said blower means to circulate heated air to said nozzle outlets to discharge into the bowl of one or more pipes supported in said cup shaped supporting members.

2. A pipe holder and dryer according to claim 1 in which said energization controlling means comprises separate switches controlling said blower means and said heating means.

3. A pipe holder and dryer according to claim 1 in which said energization controlling means includes time controlled switch means controlling energization of said blower means and said heating means.

4. A pipe holder and dryer according to claim 1 in which said energization controlling means comprises separate switches controlling said blower means and said heating means and connected so that said heating means can be energized only when said blower means is energized.

5. A pipe holder and dryer according to claim 4 including thermostatic means operable to de-energize said blower means and said heating means upon occurence of a predetermined air temperature in said housing.

6. A pipe holder and dryer according to claim 1 in which upper housing portion includes a plurality of radially extending portion defining radial conduit leading separately to said nozzle outlets.

7. A pipe holder and dryer according to claim 1 in which said radially extending support members comprise pivotally supported arms formed of two pieces, one telescoping inside the other for adjustment of radial position of said cup shaped members.

8. A pipe holder and dryer according to claim 1 in which said blower means comprises a blower and an electric motor for driving the same positioned in said housing base portion adjacent to said air inlet means, and said electric heating means comprises at least one electric resistance heater positioned on the outlet side of said blower and connected in parallel with said blower motor.

* * * * *